US005491315A

United States Patent [19]

McMills et al.

[11] Patent Number: 5,491,315

[45] Date of Patent: Feb. 13, 1996

[54] SWITCHING DEVICE WITH SLIDABLE SWITCH

[75] Inventors: Corey McMills, Los Altos; John Mattis, Sunnyvale, both of Calif.

[73] Assignee: Raychem Corporation, Menlo Park, Calif.

[21] Appl. No.: 118,120

[22] Filed: Sep. 7, 1993

[51] Int. Cl.[6] ..... H01H 1/38

[52] U.S. Cl. ..... 200/504

[58] Field of Search ..... 200/504

[56] References Cited

U.S. PATENT DOCUMENTS

| | | | |
|---|---|---|---|
| 2,805,399 | 9/1957 | Leeper . | |
| 2,948,793 | 8/1960 | Lanctot | 200/504 |
| 3,036,282 | 5/1962 | Lanctot | 200/504 X |
| 3,196,382 | 7/1965 | Morello, Jr. . | |
| 3,264,602 | 8/1966 | Schwartz . | |
| 3,301,983 | 1/1967 | Collins et al. | 200/504 |
| 3,374,449 | 3/1968 | Moore et al. | 200/504 X |
| 3,550,064 | 12/1970 | Caller et al. . | |
| 3,697,930 | 10/1972 | Shirey . | |
| 3,710,005 | 1/1973 | French . | |
| 3,731,378 | 5/1973 | Toma et al. . | |
| 3,781,762 | 12/1973 | Quackenbush . | |
| 3,963,321 | 6/1976 | Burger et al. . | |
| 4,053,200 | 10/1977 | Pugner . | |
| 4,168,921 | 9/1979 | Blanchard . | |
| 4,173,385 | 11/1979 | Fenn et al. . | |
| 4,249,790 | 2/1981 | Ito et al. . | |
| 4,583,811 | 4/1986 | McMills . | |
| 4,674,813 | 6/1987 | Feldner . | |
| 4,789,355 | 12/1988 | Lee . | |
| 4,806,116 | 2/1989 | Ackerman . | |
| 4,834,675 | 5/1989 | Samishisen . | |
| 4,998,894 | 3/1991 | Gronvall . | |
| 5,066,248 | 11/1991 | Gaver et al. . | |

FOREIGN PATENT DOCUMENTS

| | | |
|---|---|---|
| 1565981 | 4/1966 | Germany . |
| 621459 | 4/1949 | United Kingdom . |
| 2013420 | 8/1979 | United Kingdom . |

*Primary Examiner*—Renee S. Luebke

*Attorney, Agent, or Firm*—Herbert G. Burkard; A. Stephen Zavell

[57] ABSTRACT

A switching device for electrically activating and deactivating a coaxial cable junction between a coaxial cable terminus and a connection jack, where both the terminus and connection jack have external and internal conductors, is disclosed. The switching device comprises an electrically conductive housing having a first end adapted to be physically connected to the external terminus conductor, and a second end adapted to be physically connected to the external connection jack conductor. An interior member disposed within the housing, has a first end adapted to be electrically connected to the internal terminus conductor, and a second end adapted to be electrically connected to the internal connection jack conductor. A first electrically conductive path lies between the first and second end of the interior member, and a switch is disposed within this conductive path. The switch is capable of being alternated between (i) a first position wherein high frequency electrical signals are substantially transmittable between the terminus and connection jack, and (ii) a second position wherein high frequency electrical signals are substantially not transmittable between the terminus and connection jack.

14 Claims, 3 Drawing Sheets

SWITCHING DEVICE WITH SLIDABLE SWITCH

UNITED STATES PATENT APPLICATIONS INCORPORATED BY REFERENCE

This application incorporates herein completely the entirety of U.S. patent application Ser. No. 07/981,974, filed Nov. 25, 1992, now U.S. Pat. No. 5,362,250, U.S. patent application Ser. No. 07/911,427, filed Jul. 10, 1992, now U.S. Pat. No. 5,277,598, U.S. patent application Ser. No. 07/897,621, filed Jun. 11, 1992, now U.S. Pat. No. 5,207,602, U.S. patent application Ser. No. 07/509,669, filed Apr. 19, 1990, now U.S. Pat. No. 5,127,853, U.S. patent application Ser. No. 07/434,068, filed Nov. 8, 1989, now abandoned, and U.S. patent application Ser. No. 07/364,917, filed Jun. 9, 1989, now abandoned.

BACKGROUND

This invention is related to a switching device for electrically activating and deactivating a coaxial cable junction.

In the communication industry and especially in the cable TV industry, it is frequently necessary to activate and deactivate certain coaxial cable equipment junction points to activate or deactivate a user's service.

One method of activating or deactivating a coaxial cable junction is to physically connect or disconnect the cable equipment components which form the junction. However, physically disconnecting the equipment components from one another allows moisture to ingress into the exposed component connection points resulting in corrosion of these components. Corrosion is particularly pernicious for coaxial cable junctions transporting high frequency electrical signals, because the corroded portions reflect the high frequency signals thereby further contributing to signal loss.

Furthermore, it is difficult to reconnect coaxial cable equipment components with the same "tightness" as in the initial connection. Loose connections can result in loss of signal or can cause intermittent or faulty transmission. Also, the repeated connecting and disconnecting of cable components can cause mechanical wear to the components. The damaged components further contribute to signal loss.

Thus, it is desirable to have a coaxial cable switching device which can deactivate and reactivate coaxial cable junctions without requiring the physical disconnection of the cable components which form the junction.

Ordinary electrical switches, however, are generally not satisfactory in coaxial cable systems because they cannot be easily protected from unauthorized tampering. For example, an ordinary electrical switch used to activate and deactivate a user's residence could easily be switched from the "deactivate" position to the "activate" position unless the switch is somehow enclosed in some sort of bulky lock box.

Thus, there is a need for a coaxial cable switching device that allows activation and deactivation of coaxial cable junctions without requiring physical disconnection of the cable components and which can limit access to the activating and deactivating mechanism.

SUMMARY

The switching device of the present invention satisfies these needs. The device of the invention allows a coaxial cable junction to be electrically activated or deactivated without physical disconnection of the cable components which comprise the junction.

The switching device of the present invention is useful with most standard coaxial cable components wherein both components have external and internal conductors. The switching device comprises:

(a) an electrically conductive housing having a first end adapted to be physically connected to the external conductor of a first coaxial cable component, and a second end adapted to be physically connected to the external conductor of a second coaxial cable component;

(b) an interior member disposed within the housing, the interior member having a first end adapted to be electrically connected to the internal conductor of the first coaxial cable component, and a second end adapted to be electrically connected to the internal conductor of the second coaxial cable component;

(c) an electrically conductive path electrically connecting the first end of the interior member to the second end of the interior member; and (d) a slidable switch disposed within the conductive path, the switch being capable of being alternated between (i) a first position wherein high frequency electrical signals are substantially transmittable between the first and second coaxial cable components, and (ii) a second position wherein high frequency electrical signals are substantially not transmittable between the first and second coaxial cable components.

The device is sufficiently small so that it can be conveniently housed within a locking shroud, to prevent unauthorized tampering.

Preferably, the switch further comprises a second electrically conductive path between the switch and the housing, so that, when the switch is in the second position, the second electrically conductive path electrically connects the first electrically conductive path to the housing.

In a preferred embodiment useful in a junction between a coaxial cable terminus and a standard connection jack, the switch comprises a cap and a jacket. The cap is detachably attached to the external conductor of the connection jack. The jacket is slidably disposed over the cap and is capable of being alternatively moved between the first and second switching positions. The cap has an exterior surface with spaced apart first and second annular grooves therein, and the jacket has an interior surface with an annular channel therein. A ring is situated within the jacket channel which has a biased portion extending from the channel. When the jacket is in the first switching position, the biased portion of the ring engages the first annular groove, and when the jacket is in the second switching position, the biased portion of the ring engages the second annular groove.

DRAWINGS

These and other features, aspects and advantages of the present invention will become better understood with regard to the following description, appended claims, and accompanying drawings, where:

DESCRIPTION

A switching device 10 of the present invention can be used for electrically activating and deactivating a coaxial cable junction between a first coaxial cable component 12 and a second coaxial cable component 14 without physically disconnecting the components 12 and 14 from one another.

Figure 1:
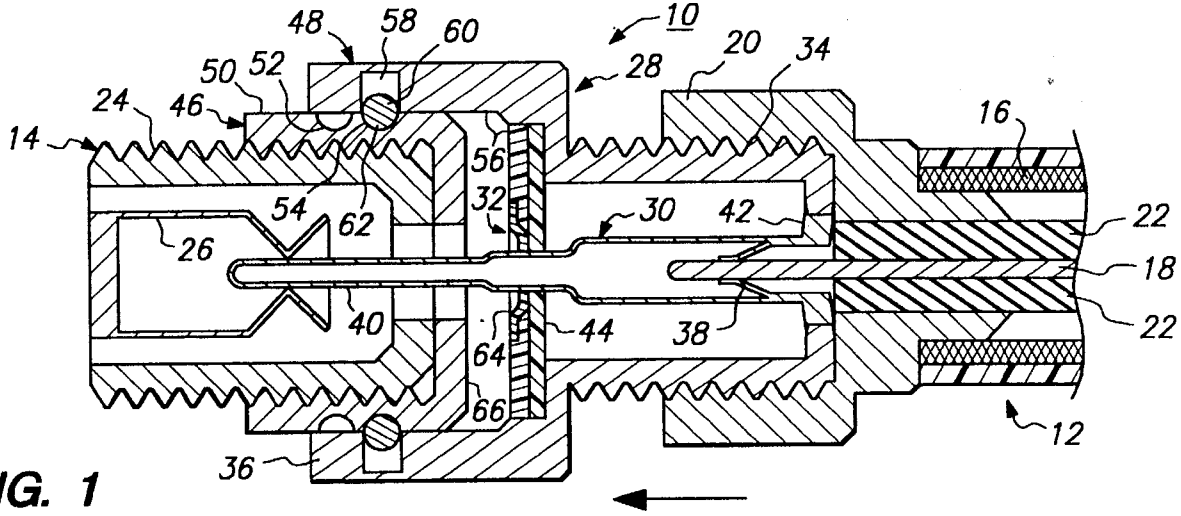
FIG. 1 is a side elevation in partial cross-section of a switching device having features of the present invention showing the switch in a first position wherein high frequency electrical signals are substantially transmittable between two coaxial cable components.
Figure 2:
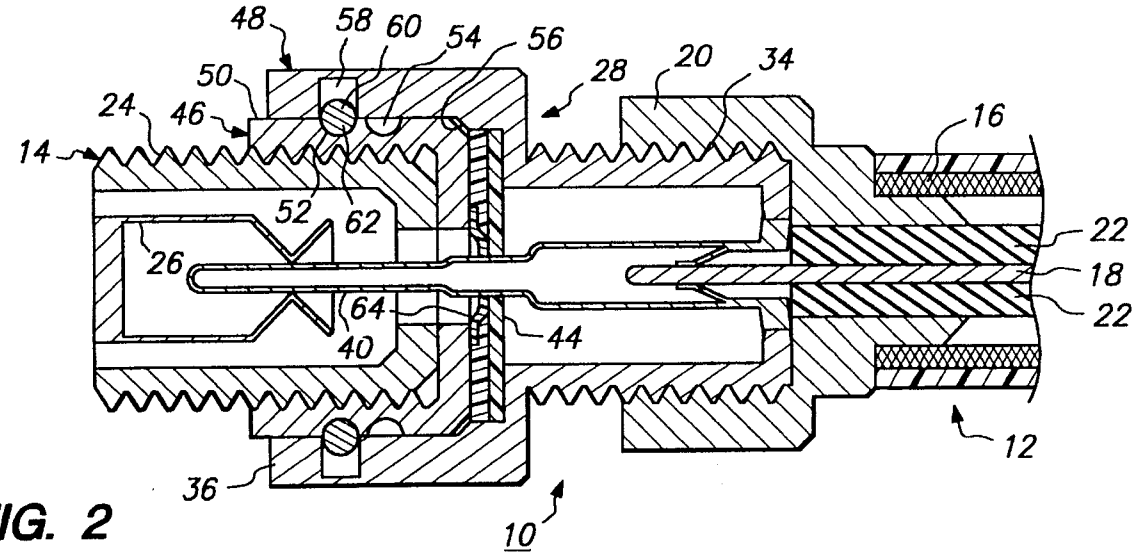
FIG. 2 is a side elevation in partial cross-section of the switching device of FIG. 1 showing the switch in a second position wherein high frequency electrical signals are substantially not transmittable between two coaxial cable components.
Figure 3:
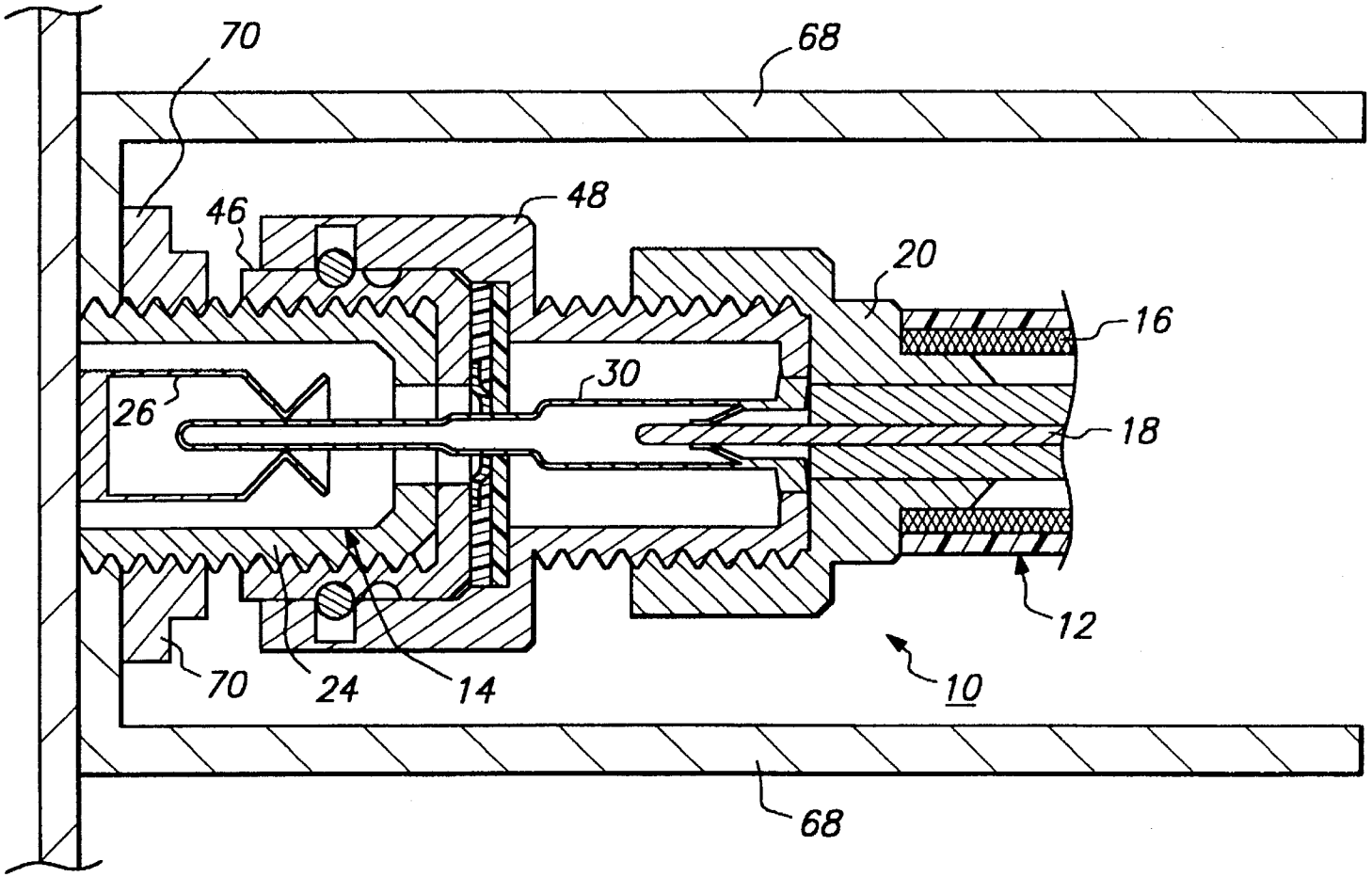
FIG. 3 is a cross-sectional side view of the switching device of FIG. 1 as shown attached to a connection jack within a protective shroud.

In the embodiments illustrated in FIGS. 1–3, the first coaxial cable component 12 is a coaxial cable terminus and the second coaxial cable component 14 is a coaxial cable connection jack. The first coaxial cable component 12 has an external conductor 16 and an internal conductor 18. The cable terminus has a connection jack connector 20 which is in electrical contact with the external conductor 16. The internal conductor 18 is insulated from the connection jack connector 20 by an insulation layer 22 within the cable terminus. The second coaxial cable component 14 also has an external conductor 24 and an internal conductor 26.

The switching device 10 comprises a housing 28, an interior member 30, a first electrically conductive path, and a switch 32.

The housing 28 has a first end 34 adapted to be connected to the external conductor 16 of the first coaxial cable component 12, and a second end 36 adapted to be connected to the external conductor 24 of the second coaxial cable component 14.

The interior member 30 is disposed within the housing 28. The interior member 30 has a first end 38 adapted to be connected to the internal conductor 18 of the first coaxial cable component 12, and a second end 40 adapted to be connected to the internal conductor 26 of the second coaxial cable component 14. The interior member 30 can be a hollow conductive pin as illustrated in the drawings.

The interior member 30 is held within the housing 28 by a first insulator 42 disposed at the first end 38 of the interior member 30, and a second insulator 44 disposed at the second end 40 of the interior member 30. Preferably, the insulators 42 and 44 are made from a hard and tough plastic material such as "ULTEM 1000," manufactured by General Electric Plastics Division, Pittsfield, Mass. ULTEM 1000 can be injection molded for ease of manufacturing and puncture resistance.

The first electrically conductive path electrically connects the first end 38 of the interior member 30 and the second end 40 of the interior member 30. In the embodiment shown in the drawings, the first electrically conductive path is provided by the direct contact of the first end 38 and the second end 40.

The electrical switch 32 is disposed within the first electrically conductive path. The switch 32 is capable of being alternated between: (i) a first position wherein high frequency electrical signals are substantially transmittable between the first coaxial cable component 12 and the second coaxial cable component 14, as shown in FIG. 1, and (ii) a second position wherein high frequency electrical signals are substantially not transmittable between the first coaxial cable component 12 and the second coaxial cable component 14, as shown in FIG. 2.

In the embodiment shown in the drawings, the switch 32 comprises a cap 46 and a jacket 48. The cap 46 is detachably connected to the external conductor 24 of the connection jack, and the jacket 48 fits over the cap 46. In the embodiment shown in the drawings, the jacket 48 is disposed on the second end 36 of the conductive housing 28. The jacket 48 can be alternated between the first and second switching positions, as shown in FIGS. 1 and 2.

The first end 34 of the conductive housing 28 typically has substantially the same dimensions as the second coaxial cable component 14, so that the first coaxial cable component 12 connects to the first end 34 in the same manner as it would attach directly to the second coaxial cable component 14.

In the embodiment shown in the drawings, the cap 46 has an exterior surface 50 having spaced-apart first and second annular grooves 52 and 54, and the jacket 48 has an interior surface 56 with an annular channel 58. A ring 60 is situated within the jacket channel 58, and has a biased portion 62 extending from the channel 58. Preferably, the ring 60 is a C-shaped steel ring. When the jacket 48 is in the first switching position, the biased portion 62 engages the first annular groove 54, as shown in FIG. 1. When the jacket 48 is in the second switching position, the biased portion 62 engages the second annular groove 52, as shown in FIG. 2.

Any electrically conductive material can be used to fabricate the majority of the components of the switching device 10. Preferably, the cap 46, the jacket 48, and the interior member 30 are all made of "C3600" half-hard brass alloy and coated with a coating of tin. The brass alloy is preferred because it is easy to machine, and the tin plating is preferred because it provides good electrical contact and corrosion resistance.

It has been found that the switching device 10 is deactivated and RF signal is substantially not transmitted through the cable junction when the signal loss through the junction is greater than 50 dB. Such a signal loss can be achieved by forming an air gap between the interior member 30 and the internal cable conductor 18. The air gap is formed by retracting the interior member 30 so that the internal member 30 no longer contacts the internal conductor 26 of the first coaxial cable component 12. The air gap should be a sufficient length to create at least about a 50 dB RF isolation for a signal having a frequency ranging from 10 MHz to 1200 MHz. An air gap of about 0.25 inches is typically sufficient to create such a dB loss.

In the embodiment shown in the drawings, however, the method of achieving a signal loss greater than 60 dB is provided by a second electrically conductive path created between the interior member 30 and the housing 28, using a conductive member 64 that extends outwardly from the interior member 30. When in the second switching position, the member 64 electrically connects the interior member 30 to the housing 28, thereby substantially preventing the transmission of signals between the first coaxial cable component 12 and the second coaxial cable component 14 by draining the signal to the external conductor 16. In the embodiment illustrated in the drawings, the conductive member 64 is a disc made of brass alloy and coated with tin, so that good electrical contact is achieved between the conductive member 64 and the front face 66 of the cap 46. The use of the second electrically conductive path allows the device to be smaller in dimension than embodiments relying solely on air gaps, because embodiments with a second conductive path do not have to provide space for air gaps of 0.25 inches or more.

Preferably, the switching device 10 is designed so that the characteristic impedance of the device is substantially equal to the characteristic impedance of the coaxial cable. This is because, when an electromagnetic wave traveling in a cable encounters a change in impedance, a portion of the wave is reflected, and the amount of wave reflected is proportional to the change in impedance encountered. If the device 10 has the same impedance as the cable, then there is little signal loss. Typically, the characteristic impedance of cable used in the cable TV industry is 75 ohms, and, therefore, the impedance of the device is typically 75 ohms. The components of the device 10 that cannot be designed to have the desired impedance should be designed with small longitudinal dimensions, so that the signal reflections from either side of the component substantially cancel each other. Also, components that have impedance values that are lower or higher than the characteristic impedance can be compensated for by the use of adjacent components having opposing higher or lower impedance, so that the total impedance of the device is substantially equivalent to the desired characteristic impedance.

It is important for the device 10 to have a high shielding effectiveness. Proper shielding prevents signal ingress or signal egress from the coaxial cable junction. High shielding effectiveness is achieved by avoiding holes, slots, and other apertures in the housing 28 that which would allow signals to leak in or out of the device 10.

An on/off indicator (not shown) can be provided on the device 10 that indicates whether signal is being transmitted or not transmitted through the cable junction.

It is also preferred for the entire device 10 to be small enough to be conveniently enclosed in a tamper-proof shroud. FIG. 3 illustrates a typical installation of the switching device 10 between a standard coaxial cable connection jack and a standard coaxial connection jack connector 20. In the installation shown in FIG. 3, the switching device 10 is encompassed within a protective shroud 68 to minimize unwarranted tampering. The shroud 68 is relatively narrow so that the switch 32 cannot be activated, nor can the shroud 68 be removed without the use of special tools. The shroud 68 is firmly affixed to the connection jack by a nut 70. In this embodiment, the connection jack connector 20 is unthreaded. The connection jack connector 20 is merely press fit over the exterior surface of the connection jack. The force required to remove the connection jack connector 20 from the connection jack is chosen to be less than the force required to slide the switch 32 to the activate position. This prevents unwarranted personnel from activating the switch 32 by merely tugging on the coaxial cable as it protrudes out through the open end of the protective shroud 68.

Figure 4:
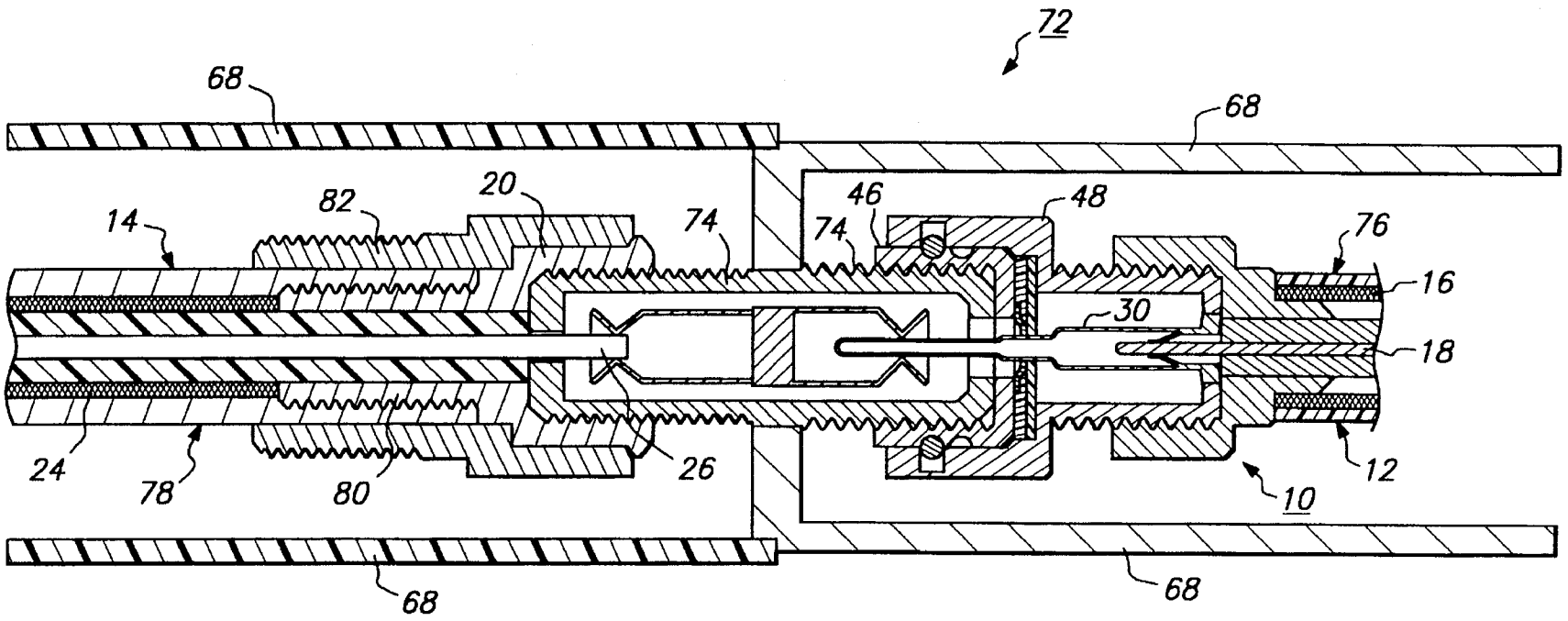
FIG. 4 is a cross-sectional side view of the switching device of FIG. 1 showing the device as used in a cable splicing device.

FIG. 4 illustrates a typical installation of the switching device 10 as it is used in a line splicing device 72. The line splicing device 72 comprises a pair of back-to-back connection jacks 74, each surrounded by the walls of a protective shroud 68. A first cable terminus 76 is attached to one of the connection jacks 74 of the splicing device 72 and the second cable terminus 78 is attached to the other jack 74 of the splicing device 72. The first cable terminus 76 is attached to the first coaxial jack 74 using a coaxial cable connection system described in our previously filed U.S. patent Ser. No. 07/912,106, now U.S. Pat. No. 5,297,972. In this system, the connection jack connector 20 comprises a screw mandrel 80 which threads its way into the cable terminus 76 to make positive contact with the external conductor 16 of the cable terminus 76. A swagging shell 82 is press fit over the connection connector 20 to hold the connection jack connector 20 to the first connection jack 74 with considerable force. In this system, the cable terminus 76 cannot be disconnected from the jack 74 without use of a special tool designed to retract the swagging shell 82 from the connection jack connector 76.

The second cable terminus 78 in the splicing device 72 illustrated in FIG. 4 is attached to the switching device 10. The switching device 10 is attached to the second connection jack 74. This assembly is equivalent to the assembly illustrated in FIG. 3 and described above.

Although the present invention has been described in considerable detail with regard to the preferred version thereof, other versions are possible. Therefore, the appended claims should not be limited to the description of the preferred versions contained herein.

What is claimed is:

1. A switching device for electrically activating and deactivating a coaxial cable junction between a first coaxial cable component and a second coaxial cable component, both having external and internal conductors, the switching device comprising:

(a) an electrically conductive housing having a first end adapted to be physically connected to the external conductor of the first component, and a second end adapted to be physically connected to the external conductor of the second component;

(b) an interior member disposed within the housing, the interior member having a first end adapted to be electrically connected to the internal conductor of the first component, and a second end adapted to be electrically connected to the internal conductor of the second component;

(c) a first electrically conductive path between the first end of the interior member and the second end of the interior member;

(d) a slidable switch disposed within the conductive path, the switch capable of being alternated between (i) a first position wherein high frequency electrical signals are substantially transmittable between the first and second coaxial cable components, and (ii) a second position wherein high frequency electrical signals are substantially not transmittable between the first and second coaxial cable components; and (e) a second electrically conductive path between the switch and the housing, wherein, in the second switch position, the second electrically conductive path electrically connects the first electrically conductive path to the housing, thereby substantially preventing the transmission of signals between the first and second coaxial cable components;

wherein the first electrically conductive path is formed by conductive material extending continuously from the first end of the interior member to the second end of the interior member, and wherein the second electrically conductive path comprises an electrically conductive disc extending radially outwardly from the interior member.

2. The switching device of claim 1, wherein, in the second position, the switch causes signal loss of at least about 50 dB between the first and second coaxial cable components.

3. The switching device of claim 1, wherein the interior member is a hollow pin.

4. The switching device of claim 1, wherein the first end of the housing has substantially the same external dimensions as a connection jack.

5. The switching device of claim 1, wherein one of the two ends of the switching device is shaped and dimensioned to connect to a connection jack.

6. The switching device of claim 1, wherein one of the two ends of the switching device is shaped and dimensioned to connect to a coaxial cable terminus.

7. The switching device of claim 1 further comprising coaxial cable with a characteristic impedance, and wherein the switching device has a characteristic impedance substantially equal to the characteristic impedance of the cable.

8. The switching device of claim 1, wherein the switch has a characteristic impedance of about 75 ohms.

9. The switching device of claim 1, wherein the switch comprises:

(a) a cap detachably attached to the external connection jack conductor; and (b) a jacket slidably disposed over the cap, the jacket capable of being alternatively moved between the first and second switching positions.

10. The switching device of claim 9, wherein the cap has an exterior surface with spaced apart first and second annular grooves therein and the jacket has an interior surface with an annular channel therein, and wherein a ring is situated within the jacket channel, the ring having a biased portion extending from the jacket channel, so that, when the jacket is in the first switching position, the biased portion of the ring engages the first annular groove on the cap, and when the jacket is in the second switching position, the biased portion of the ring engages the second annular groove on the cap.

11. The switching device of claim 9, wherein the cap is dimensioned to fit over an F-port device.

12. A switching device for electrically activating and deactivating a coaxial cable junction between a first coaxial cable component and a second coaxial cable component, both having external and internal conductors, the switching device comprising:

(a) an electrically conductive housing having a first end adapted to be physically connected to the external conductor of the first component, and a second end adapted to be physically connected to the external conductor of the second component;

(b) an interior member disposed within the housing, the interior member having a first end adapted to be electrically connected to the internal conductor of the first component, and a second end adapted to be electrically connected to the internal conductor of the second component;

(c) a first electrically conductive path between the first end of the interior member and the second end of the interior member; and (d) a switch disposed within the conductive path, the switch capable of being alternated between (i) a first position wherein high frequency electrical signals are substantially transmittable between the first and second coaxial cable components, and (ii) a second position wherein high frequency electrical signals are substantially not transmittable between the first and coaxial cable components;

wherein the switch further comprising a second electrically conductive path between the switch and the housing, wherein, in the second switch position, the second electrically conductive path electrically connects the first electrically conductive path to the housing;

wherein the first electrically conductive path is formed by conductive material extending continuously from the first end of the interior member to the second end of the interior member, and wherein the second electrically conductive path comprises an electrically conductive disc extending radially outwardly from the interior member;

wherein the switch comprises (i) a cap detachably attached to the external connection jack conductor; and (ii) a jacket slidably disposed over the cap, the jacket capable of being alternatively moved between the first and second switching positions;

wherein the interior member is a hollow pin;

wherein the first end of the housing has substantially the same external dimensions as the connection jack so that a cable terminus can connect to the first end of the housing in the same manner as it would to a connection jack.

13. A combination comprising:

(a) a coaxial cable connection jack having an internal conductor and an external conductor;

(b) a coaxial cable component comprising a coaxial cable terminus and a coaxial cable jack connector attached thereto, the coaxial cable terminus having an internal conductor and an external conductor;

(c) a switching device comprising:

i. an electrically conductive housing having a first end adapted to be physically connected to the external conductor of the connection jack, and a second end adapted to be physically connected to the external conductor of the coaxial cable terminus;

ii. an interior member disposed within the housing, the interior member having a first end adapted to be electrically connected to the internal conductor of the connection jack, and a second end adapted to be electrically connected to the internal conductor of the coaxial cable terminus;

iii. a first electrically conductive path between the first end of the interior member and the second end of the interior member; and iv. a slidable switch disposed within the conductive path, the switch capable of being alternated between (i) a first position wherein high frequency electrical signals are substantially transmittable between the connection jack and the coaxial cable component, and (ii) a second position wherein high frequency electrical signals are substantially not transmittable between the connection jack and the coaxial cable component; and (d) a protective shroud attached to the connection jack, the protective shroud having extended sidewalls which surround the connection jack, the switching device and the connection jack connector.

14. A coaxial cable splicing device comprising:

(a) back-to-back coaxial cable connection jacks, both having an internal conductor and an external conductor;

(b) a protective shroud attached to the coaxial cable connection jacks, the protective shroud comprising elongated sidewalls which surround the coaxial cable connection jacks;

(c) a switching device attached to one of the connection jacks, the switching device comprising:

i. an electrically conductive housing having a first end adapted to be physically connected to the external conductor of one of the connection jacks, and a second end adapted to be physically connected to the external conductor of the other connection jack;

ii. an interior member disposed within the housing, the interior member having a first end adapted to be electrically connected to the internal conductor of one of the connection jacks, and a second end adapted to be electrically connected to the internal conductor of the other connection jack;

iii. a first electrically conductive path between the first end of the interior member and the second end of the interior member; and iv. a slidable switch disposed within the conductive path, the switch capable of being alternated between (i) a first position wherein high frequency electrical signals are substantially transmittable between the two connection jacks, and (ii) a second position wherein high frequency electrical signals are substantially not transmittable between the two connection jacks.

* * * * *